US009221260B2

(12) United States Patent
Domae et al.

(10) Patent No.: US 9,221,260 B2
(45) Date of Patent: Dec. 29, 2015

(54) LIQUID JET HEAD, LIQUID JET APPARATUS AND METHOD OF MANUFACTURING LIQUID JET HEAD

(71) Applicant: SII PRINTEK INC., Chiba-shi, Chiba (JP)

(72) Inventors: Yoshinori Domae, Chiba (JP); Yuki Yamamura, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/338,803

(22) Filed: Jul. 23, 2014

(65) Prior Publication Data

US 2015/0029271 A1 Jan. 29, 2015

(30) Foreign Application Priority Data

Jul. 29, 2013 (JP) ..... 2013-157018

(51) Int. Cl.
*B41J 2/045* (2006.01)
*B41J 2/14* (2006.01)
*B41J 2/16* (2006.01)

(52) U.S. Cl.
CPC ..... *B41J 2/1623* (2013.01); *B41J 2/14209* (2013.01); *B41J 2/1609* (2013.01); *B41J 2/1632* (2013.01); *B41J 2/1642* (2013.01); *B41J 2002/14491* (2013.01)

(58) Field of Classification Search
CPC .... B41J 2/1623; B41J 2/14209; B41J 2/1609; B41J 2/1632; B41J 2/1642; B41J 2002/14491
USPC ..... 347/50, 68, 71
See application file for complete search history.

(56) References Cited

U.S. PATENT DOCUMENTS

2013/0187986 A1* 7/2013 Koseki ..... 347/47
2014/0118440 A1* 5/2014 Kubota ..... 347/40

FOREIGN PATENT DOCUMENTS

JP 2008068555 3/2008
JP 2012006181 1/2012

* cited by examiner

*Primary Examiner* — Stephen Meier
*Assistant Examiner* — Alexander D Shenderov
(74) *Attorney, Agent, or Firm* — Adams & Wilks

(57) ABSTRACT

A liquid jet head includes a piezoelectric body substrate having an upper surface, a lower surface, at least two groove arrays each having ejection grooves penetrating from the upper surface to the lower surface, and a first opening portion penetrating from the upper surface to the lower surface between the at least two groove arrays. Drive electrodes are provided on side surfaces of the ejection grooves and terminal electrodes are electrically connected to the drive electrodes. A flexible circuit board is electrically connected to the terminal electrodes and extends from the lower surface to the upper surface of the piezoelectric body substrate through the first opening portion.

19 Claims, 9 Drawing Sheets

LIQUID JET HEAD, LIQUID JET APPARATUS AND METHOD OF MANUFACTURING LIQUID JET HEAD

BACKGROUND

1. Technical Field

The present invention relates to a liquid jet head that jets liquid droplets onto, and thereby record information on, recording media, a liquid jet apparatus having such a liquid jet head, and also relates to a method of manufacturing such a liquid jet head.

2. Related Art

Recently, there has been used a liquid jet head of an ink jet system that ejects ink droplets onto a recording paper or the like to record characters or figures thereon, or ejects a liquid material onto the surface of an element substrate to form a functional thin film thereon. In this technique, liquid such as ink or liquid material is guided from a liquid tank through a liquid supply tube to a channel, and is ejected in the form of liquid droplets from nozzles that communicate with the channel by applying a pressure on the liquid filling the channel. When liquid droplets are ejected, the liquid jet head and/or the recording medium is moved to record characters and/or figures, or to form a functional thin film or a three-dimensional structure each having a predetermined shape.

This kind of liquid jet head has an actuator portion having an array of a plurality of channels, which constitute a channel row, for momentarily applying a pressure on liquid; a liquid supply portion having a liquid chamber for supplying the liquid to each of the channels; a nozzle plate having an array of a plurality of nozzles that communicate with the plurality of channels, and thus jet liquid droplets. In recent years, as recording density increases, a single liquid jet head constituting a plurality of channel rows therein has been put into practical use. However, since a drive signal needs to be independently supplied to each of the channels, an increase in the number of the channel rows results in complexity in the wiring of electrodes for supplying the drive signals. When a plurality of liquid jet heads individually manufactured are arranged to constitute a plurality of channel rows, the volume of the entire liquid jet head becomes large, and at the same time, manufacturing variation makes it difficult to align the nozzle positions of the respective liquid jet heads with high accuracy.

JP 2008-68555 A describes a liquid jet head having four nozzle arrays. FIG. 10 is an exploded perspective view of a liquid jet head described in JP 2008-68555 A. The liquid jet head includes a liquid chamber unit 106, in which four nozzle arrays are formed; an actuator unit 104, in which four piezoelectric element members 142 are provided on an upper surface of a base member 141; and a frame unit 105 that incorporates the actuator unit 104 in a container portion 152, and that supplies liquid to the liquid chamber unit 106. The liquid chamber unit 106 includes a nozzle plate 101, in which the four nozzle arrays are formed in parallel; a flow path member 102, in which four arrays of liquid chambers for pressurizing liquid are formed, the flow path member 102 being bonded to the nozzle plate 101 so that the liquid chambers in each array communicates with corresponding one of the nozzles 111 in each array; and an oscillation member 103 bonded to the flow path member 102 so as to block the liquid chambers, the oscillation member 103 transmitting oscillation independently to each of the liquid chambers in each array. The four piezoelectric element members 142 of the actuator unit 104 are bonded in correspondence to the four arrays of the liquid chambers. The piezoelectric element members 142 transmit oscillation independently to each of the liquid chambers of the respective array. The frame unit 105 includes four common liquid chambers 151 that supply liquid to liquid chambers in each array.

Here, the base member 141, which holds the four piezoelectric element members 142, has a through hole 144 between the second array of piezoelectric element member 142 and the third array of piezoelectric element member 142. This through hole 144 allows flexible circuit boards (FPC cables 143) to pass therethrough. That is, the first array of piezoelectric element members 142 and the fourth array of piezoelectric element members 142 are respectively connected to two FPC cables 143 provided along outer side faces of the base member 141. The second array of piezoelectric element members 142 and the third array of the piezoelectric element members 142 are respectively connected to two FPC cables 143 that pass through the through hole 144 of the base member 141. The FPC cables 143 are respectively connected to side faces of the piezoelectric element members 142, and are each electrically connected to terminals of respective piezoelectric elements of the corresponding array.

JP 2012-6181 A describes a liquid jet head in which a first to a fourth channel rows are formed. Each of the channels includes an elongated groove formed on a surface of a piezoelectric body substrate. A drive electrode is formed on a side face of a sidewall that separates every two adjacent grooves, and a drive signal is supplied to this drive electrode to cause thickness-shear mode deformation in the sidewall, and thus a pressure is applied to liquid that fills the groove. Liquid droplets are thus ejected through a nozzle that communicates with a corresponding groove. The piezoelectric body substrates in the first and the fourth rows have the grooves formed each extending straight from the front end to the back end of the substrate. The piezoelectric body substrates in the second and the third rows have the grooves formed each starting from the front end and terminating before the back end of the substrate, and in the vicinity of the terminating point, the depth of each groove gradually decreases toward the back end of the substrate. In the piezoelectric body substrates in the first and the fourth rows, lead electrodes that are electrically connected to the drive electrodes provided on the side faces of the grooves are led out to side faces of the back ends of the piezoelectric body substrates, and are then connected to flexible circuit boards at the side faces of the back ends. In the piezoelectric body substrates in the second and the third rows, lead electrodes that are electrically connected to the drive electrodes provided on the side faces of the grooves are led out to surfaces of the substrates near the back ends of the piezoelectric body substrates, and are then connected to FPC cables at the surfaces of the substrates. The piezoelectric body substrates of the first to the fourth rows are individually manufactured, and are then bonded together by adhesive to be integrated.

The liquid jet head described in JP 2008-68555 A includes a very large number of components, and is thus complex to manufacture, which results in low productivity. For example, with respect to the piezoelectric element members 142 in the second and the third rows, which are provided facing each other across the through hole 144, it has been difficult to crimp the FPC cables 143 on the side faces on the through hole 144 side after the piezoelectric element members 142 are adhered to the base member 141. To avoid this difficulty, first the FPC cables 143 are crimped on, and connected to, the side faces of the piezoelectric element members 142, and after that, the piezoelectric element members 142 to which the FPC cables 143 are connected are bonded to the base member 141.

Thus, the assembly process becomes more complicated, and alignment becomes more difficult.

The liquid jet head described in JP 2012-6181 A are manufactured in such a manner that the piezoelectric body substrates for the first to the fourth rows are individually manufactured, the piezoelectric body substrates for the second and the third rows are bonded together, the piezoelectric body substrate for the first row is bonded to the upper surface of the piezoelectric body substrate for the second row, and the piezoelectric body substrate for the fourth row is bonded to the lower surface of the piezoelectric body substrate for the third row. Thus, alignment of the grooves of the respective rows becomes complicated. Moreover, difference between the shape of the grooves of the first and the fourth rows and the shape of the grooves of the second and the third rows creates difficulty in keeping the ejection conditions of the respective rows constant.

SUMMARY

A liquid jet head according to the present invention includes a piezoelectric body substrate having a plurality of groove arrays, in each of which ejection grooves penetrating from an upper surface to an lower surface are arrayed in a reference direction, drive electrodes provided on side faces of the ejection grooves, and terminal electrodes provided on the lower surface, and electrically connected to the drive electrodes; and a flexible circuit board electrically connected from the terminal electrodes, and connected to the lower surface of the piezoelectric body substrate. The piezoelectric body substrate includes a first opening portion that penetrates from the upper surface to the lower surface between the plurality of groove arrays, and the flexible circuit board is led out from the lower surface to the upper surface of the piezoelectric body substrate through the first opening portion.

The liquid jet head further includes a cover plate having a liquid chamber configured to communicate with the ejection grooves, the cover plate being bonded to the upper surface of the piezoelectric body substrate. The cover plate includes a second opening portion that penetrates in a plate thickness direction, and the flexible circuit board is led out through the second opening portion.

The liquid jet head further includes a flow path plate bonded to an opposite surface of the piezoelectric body substrate of the cover plate, and having flow paths that communicate with the liquid chamber. The flow path plate includes a third opening portion that penetrates from a cover plate side to a side opposite the cover plate, and the flexible circuit board is led out through the third opening portion.

The piezoelectric body substrate includes non-ejection grooves that penetrate from the upper surface to the lower surface, and arrayed alternately with the ejection grooves in the reference direction, and drive electrodes provided on side faces of the non-ejection grooves.

The piezoelectric body substrate includes four of the groove arrays along the reference direction in parallel, and the first opening portion is disposed between a second one and a third one of the groove arrays, and a first one and a second one of the groove arrays adjacent to each other, or a third one and a fourth one of the groove arrays adjacent to each other, are arranged such that an end portion on one side of the ejection grooves included in a groove array disposed on the other side, and an end portion on the other side of the non-ejection grooves included in another groove array disposed on the one side are spaced apart from each other, and overlap with each other in a thickness direction of the piezoelectric body substrate.

The liquid jet head further includes a nozzle plate having a plurality of nozzle arrays, in each of which nozzles configured to communicate with the ejection grooves are arrayed in the reference direction, the nozzle plate being bonded to the lower surface of the piezoelectric body substrate.

A liquid jet apparatus according to an embodiment of the present invention includes the liquid jet head described above; a movement mechanism configured to relatively move the liquid jet head and a recording medium; a liquid supply tube configured to supply liquid to the liquid jet head; and a liquid tank configured to supply the liquid to the liquid supply tube.

A method of manufacturing a liquid jet head according to the present invention includes forming a plurality of groove arrays, in each of which ejection grooves are arrayed in a reference direction, by cutting a piezoelectric body substrate; forming drive electrodes on side faces of the ejection grooves, and terminal electrodes on the lower surface of the piezoelectric body substrate; forming a first opening portion that penetrates from the upper surface to the lower surface of the piezoelectric body substrate by cutting through a portion between two of the plurality of groove arrays adjacent to each other of the piezoelectric body substrate; and connecting a flexible circuit board, on which a wiring pattern is formed, to the lower surface of the piezoelectric body substrate through the first opening portion so that the wiring pattern and the terminal electrodes are electrically connected together.

The method of manufacturing a liquid jet head further includes bonding a cover plate, in which a plurality of liquid chambers is formed, to the upper surface of the piezoelectric body substrate so that the liquid chambers and the ejection grooves communicate with each other. The cover plate includes a second opening portion that penetrates, in a plate thickness direction, a portion between the liquid chambers adjacent to each other. The connecting includes drawing out the flexible circuit board through the second opening portion.

The method of manufacturing a liquid jet head further includes bonding a cover plate, in which a plurality of liquid chambers is formed, to the upper surface of the piezoelectric body substrate so that the plurality of liquid chambers and the ejection grooves communicate with each other. The forming a first opening portion includes forming a second opening portion that penetrates in a plate thickness direction by cutting through a portion between the liquid chambers adjacent to each other of the cover plate at the same time as forming the first opening portion, and the connecting includes drawing out the flexible circuit board through the second opening portion.

The method of manufacturing a liquid jet head further includes bonding a flow path plate to an opposite surface of the piezoelectric body substrate of the cover plate. The flow path plate includes a third opening portion that penetrates in a plate thickness direction. The connecting includes drawing out the flexible circuit board through the third opening portion.

The method of manufacturing a liquid jet head further includes bonding a flow path plate to an opposite surface of the piezoelectric body substrate of the cover plate. The forming a first opening portion includes forming a third opening portion that penetrates in a plate thickness direction by cutting through the flow path plate at the same time as forming the first and the second opening portions, and the connecting a circuit board includes drawing out the flexible circuit board through the third opening portion.

The method of manufacturing a liquid jet head further includes bonding a nozzle plate to the lower surface of the piezoelectric body substrate. The bonding a nozzle plate includes exposing regions of the piezoelectric body substrate where the terminal electrodes are formed by cutting the nozzle plate after the nozzle plate is bonded to the lower surface of the piezoelectric body substrate.

The forming groove arrays includes forming the ejection grooves by cutting the piezoelectric body substrate from the upper surface, and forming the non-ejection grooves by cutting the piezoelectric body substrate from the lower surface.

A liquid jet head according to the present invention includes a piezoelectric body substrate having a plurality of groove arrays, in each of which ejection grooves penetrating from an upper surface to an lower surface are arrayed in a reference direction, drive electrodes provided on side faces of the ejection grooves, and terminal electrodes provided on the lower surface, and electrically connected to the drive electrodes; and a flexible circuit board electrically connected from the terminal electrodes, and connected to the lower surface of the piezoelectric body substrate. The piezoelectric body substrate includes a first opening portion that penetrates from the upper surface to the lower surface between the plurality of groove arrays, and the flexible circuit board is led out from the lower surface to the upper surface of the piezoelectric body substrate through the first opening portion. Thus, an increase in the number of the groove arrays still allows the terminal electrodes and an external circuit to be easily connected together.

BRIEF DESCRIPTION OF THE DRAWINGS

FIGS. 6S1 to 6S4 are drawings for explaining the respective steps of the fourth embodiment of the present invention;

FIGS. 8S1 to 8S7 are drawings for explaining the respective steps of the fifth embodiment of the present invention;

DETAILED DESCRIPTION

First Embodiment

Figure 1A:
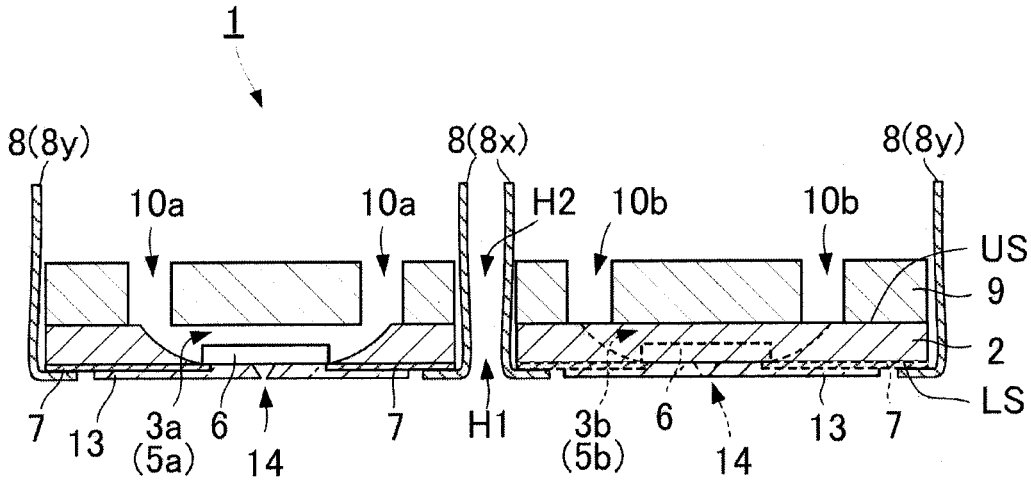
FIGS. 1A and 1B are explanatory drawings of the liquid jet head according to the first embodiment of the present invention.
Figure 1B:
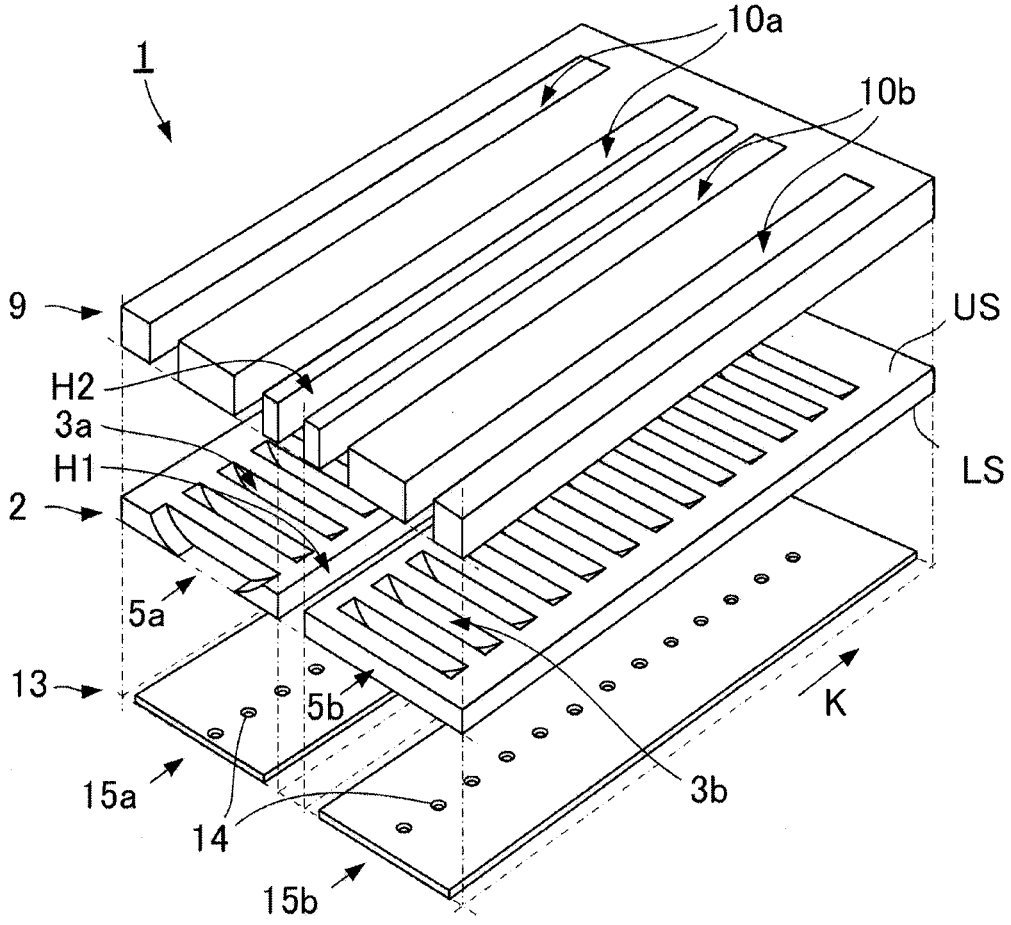

FIGS. 1A and 1B are explanatory drawings of a liquid jet head 1 according to the first embodiment of the present invention. FIG. 1A is a schematic cross-sectional view of the liquid jet head 1 in the groove length direction of ejection grooves 3. FIG. 1B is a schematic, partial exploded perspective view of the liquid jet head 1 with flexible circuit boards 8 omitted.

As shown in FIGS. 1A and 1B, the liquid jet head 1 includes a piezoelectric body substrate 2, a cover plate 9 that is bonded to an upper surface US of the piezoelectric body substrate 2, a nozzle plate 13 that is bonded to a lower surface LS of the piezoelectric body substrate 2, and flexible circuit boards 8 that are connected to the lower surface LS of the piezoelectric body substrate 2. The piezoelectric body substrate 2 includes a first groove array 5*a* and a second groove array 5*b*. A first opening portion H1 penetrating from the upper surface US to the lower surface LS is formed between the first groove array 5*a* and the second groove array 5*b*. In the first groove array 5*a*, first ejection grooves 3*a* penetrating from the upper surface US to the lower surface LS are arrayed in a reference direction K. In the second groove arrays 5*b*, second ejection grooves 3*b* penetrating from the upper surface US to the lower surface LS are arrayed in the reference direction K. Drive electrodes 6 are provided on side faces of the first and the second ejection grooves 3*a* and 3*b*. The respective drive electrodes 6 are electrically connected to terminal electrodes 7 that are provided on the lower surface LS of the piezoelectric body substrate 2. The terminal electrodes 7 are electrically connected to wiring patterns (not shown) formed on the flexible circuit boards 8.

That is, piezoelectric body substrate 2 includes the first and the second groove arrays 5*a* and 5*b*, in which the first and the second ejection grooves 3*a* and 3*b* penetrating from the upper surface US to the lower surface LS are respectively arrayed in the reference direction K; the drive electrodes 6 provided on the side faces of the first and the second ejection grooves 3*a* and 3*b*; the terminal electrodes 7 provided on the lower surface LS, and electrically connected to the drive electrodes 6; and the first opening portion H1 penetrating from the upper surface US to the lower surface LS between the first groove array 5*a* and the second groove array 5*b*. Flexible circuit boards 8*x* of the flexible circuit boards 8 are led out from the lower surface LS to the upper surface US of the piezoelectric body substrate 2 through the first opening portion H1.

The cover plate 9 includes two first liquid chambers 10*a* and two second liquid chambers 10*b*, and a second opening portion H2 penetrating in a plate thickness direction of the cover plate 9 between the first liquid chambers 10*a* and the second liquid chambers 10*b*. The two first liquid chambers 10*a* respectively communicate with both end portions of the first ejection grooves 3*a*. The two second liquid chambers 10*b* respectively communicate with both end portions of the second ejection grooves 3*b*. The second opening portion H2 communicates with the first opening portion H1 of the piezoelectric body substrate 2. The flexible circuit boards 8*x* are led out upward through the second opening portion H2. The nozzle plate 13 includes nozzles 14 that respectively communicate with corresponding ones of the first and the second ejection grooves 3*a* and 3*b*. The nozzles 14 communicating with the first ejection grooves 3*a*, and arrayed in the reference direction K, forma first nozzle array 15*a*, and the nozzles 14 communicating with the second ejection grooves 3*b*, and arrayed in the reference direction K, form a second nozzle array 15*b*. Regions of the nozzle plate 13 where the flexible circuit boards 8 are connected to the lower surface LS of the piezoelectric body substrate 2 are removed so that the terminal electrodes 7 are exposed.

The liquid jet head 1 also includes flexible circuit boards 8*y*. The flexible circuit boards 8*y* are connected to the lower surface LS on outer peripheral sides of the piezoelectric body substrate 2, and are led out upward along the side faces of the piezoelectric body substrate 2 and of the cover plate 9. The first groove array 5*a* and the second groove array 5*b* are arranged so as to be shifted from each other by one half the pitch of the ejection grooves in the reference direction K. Thus, the first nozzle array 15*a* and the second nozzle array 15*b* are also formed to be shifted with one half the pitch in the reference direction K.

As described above, the first opening portion H1 and the second opening portion H2 penetrating in the plate thickness directions are respectively formed between the first groove array 5*a* and the second groove array 5*b* of the piezoelectric body substrate 2, and between the first liquid chambers 10*a* and the second liquid chambers 10*b* of the cover plate 9. The flexible circuit boards 8*x* are then led out upward from the lower surface LS through the first and the second opening portions H1 and H2. Formation of the first ejection grooves 3*a* and the second ejection grooves 3*b* in a same process eliminates the need to align the first ejection grooves 3*a* and the second ejection grooves 3*b* during assembling. Moreover, formation of the first opening portion H1 allows the terminal electrodes 7 that connect to the first and the second groove arrays 5*a* and 5*b* to be distributed to both sides of the first and the second groove arrays 5*a* and 5*b*. This increases the array pitch of the terminal electrodes 7 in the reference direction K, thereby making easier the connection between the terminal electrodes 7 and wiring patterns of the flexible circuit boards 8. This is particularly advantageous in implementing a higher density of arrays, in the reference direction K, of the ejection grooves 3.

The piezoelectric body substrate 2 can be made using a PZT ceramic material. A polarization process is performed on the piezoelectric body substrate 2. For example, the piezoelectric body substrate 2 may be uniformly polarized in a normal direction to the upper surface US or to the lower surface LS, or a piezoelectric body substrate of a chevron type may be used, which is prepared by bonding a piezoelectric body substrate polarized in a normal direction to the upper surface US or to the lower surface LS and a piezoelectric body substrate polarized in the opposite direction. Note that it is sufficient that the piezoelectric body substrate 2 of the present invention uses a piezoelectric body material at least on sidewalls between adjacent grooves. A non-piezoelectric body material may be used in an outer circumference, or in regions corresponding to the liquid chambers 10 of the cover plate 9, of the piezoelectric body substrate 2.

The cover plate 9 can be made using a ceramic material, a metal material, a synthetic resin, or the like. The material of the cover plate 9 preferably has a thermal expansion coefficient similar to that of the piezoelectric body substrate 2. The cover plate 9 can be made using, for example, a PZT ceramic or machinable ceramic material.

The liquid jet head 1 operates as follows. Liquid is supplied to one of the first liquid chambers 10*a*, and the liquid thus fills each of the first ejection grooves 3*a* of the first groove array 5*a*. The liquid is then discharged from each of the first ejection grooves 3*a* to the other one of the first liquid chambers 10*a*, and is thus discharged from that first liquid chamber 10*a* to the outside. The operation of the two second liquid chambers 10*b* is similar. Drive signals are supplied to the terminal electrodes 7 from the wiring patterns of the four flexible circuit boards 8*x* and 8*y*, and to the drive electrodes 6, thereby inducing thickness-shear mode deformation in sidewalls that constitute the first and the second ejection grooves 3*a* and 3*b*. For example, liquid droplets are ejected from the nozzles 14 using a pull and push technique by firstly increasing and then decreasing the volumes of the ejection grooves 3. The liquid jet head 1 having two arrays of the first and the second groove arrays 5*a* and 5*b*, and thus two arrays of the first and the second nozzle arrays 15*a* and 15*b* corresponding thereto can record information with a recording density twice as high as, or at a recording rate twice as high as, that of one having only a single groove array.

The first opening portion H1 formed in the piezoelectric body substrate 2 may fully divide the piezoelectric body substrate 2, or leave one or more portions that join both halves. Similarly, the second opening portion H2 formed in the cover plate 9 may fully divide the cover plate 9, or leave one or more portions that join both halves. Alternatively, the configuration may be such that the first opening portion H1 divides the piezoelectric body substrate 2, and the cover plate 9 has one or more portions that join both halves.

Note that although the first embodiment has been presented in terms of two arrays of the first and the second groove arrays 5*a* and 5*b*, and two arrays of the first and the second nozzle arrays 15*a* and 15*b*, more than two arrays of the groove arrays 5 and more than two arrays of the nozzle arrays 15 can be provided. In particular, when three or more arrays of the groove arrays 5 are provided, groove arrays 5 in a middle portion can be easily electrically connected to an external circuit. Moreover, the grooves that constitute each of the groove arrays 5 may be configured such that ejection grooves and non-ejection grooves are alternately disposed. The ejection grooves and the non-ejection grooves may have any shape.

Second Embodiment

Figure 2:
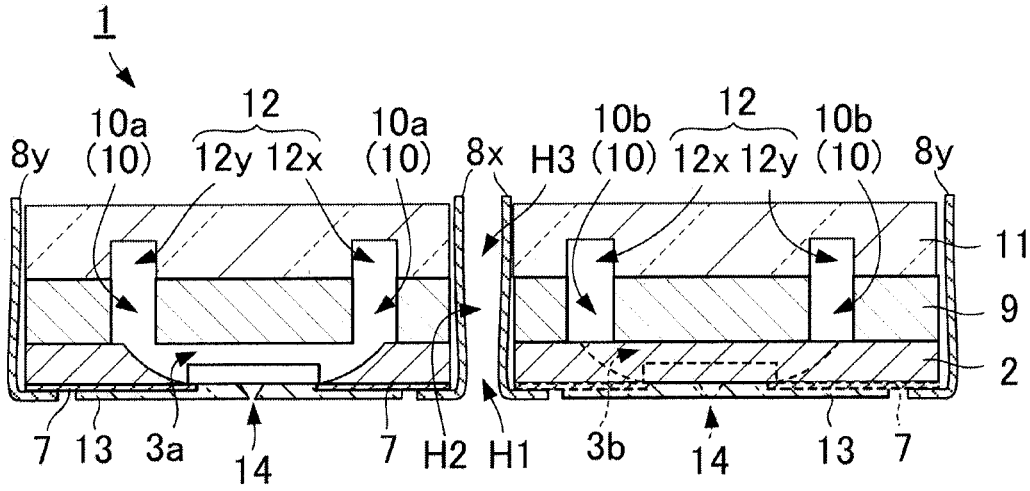
FIG. 2 is a schematic cross-sectional view of the liquid jet head according to the second embodiment of the present invention.

FIG. 2 is a schematic cross-sectional view of a liquid jet head 1 according to the second embodiment of the present invention. The liquid jet head 1 of the second embodiment differs from that of the first embodiment in that a flow path plate 11 is provided on the top of the cover plate 9. The other components are similar to those of the first embodiment. Thus, only the different components from those of the first embodiment will be discussed below, and the explanation of the same components will be omitted. The same components or components having the same function are denoted by the same marks throughout the drawings.

The liquid jet head 1 includes a flow path plate 11. The flow path plate 11 is bonded to an opposite surface of the piezoelectric body substrate 2 of the cover plate 9. The flow path plate 11 has flow paths 12 that communicate with the liquid chambers 10. The flow path plate 11 includes a third opening portion H3 penetrating from the cover plate 9 side to the side opposite the cover plate 9 (hereinafter referred to as "to penetrate in the plate thickness direction"). The third opening portion H3 communicates with the second opening portion H2 of the cover plate 9. The flexible circuit boards 8*x* are led out upward through the third opening portion H3.

More specifically, the flow path plate 11 includes a supply flow path 12*x* that communicates with one of the two first liquid chambers 10*a* and one of the two second liquid chambers 10*b*, and a discharge flow path 12*y* that communicates with the other one of the two first liquid chambers 10*a* and the other one of the two second liquid chambers 10*b*. The flow paths 12*x* and 12*y* can be constituted as an integrated part of the flow path plate 11. The flexible circuit boards 8*x* are led out in the upward direction, that is, in the direction opposite to that in which liquid droplets are ejected, through the first to the third opening portions H1 to H3 that communicate with one another. The flexible circuit boards 8*y* are led out in the upward direction, that is, in the direction opposite to that in which liquid droplets are ejected, along the side faces of the piezoelectric body substrate 2, of the cover plate 9, and of the flow path plate 11. This allows a driver and a control circuit that generates a drive signal or the like to be housed in a top section on the side opposite to which liquid droplets are ejected, and the liquid jet head 1 can thus be constituted in a compact manner.

Third Embodiment

Figure 3:
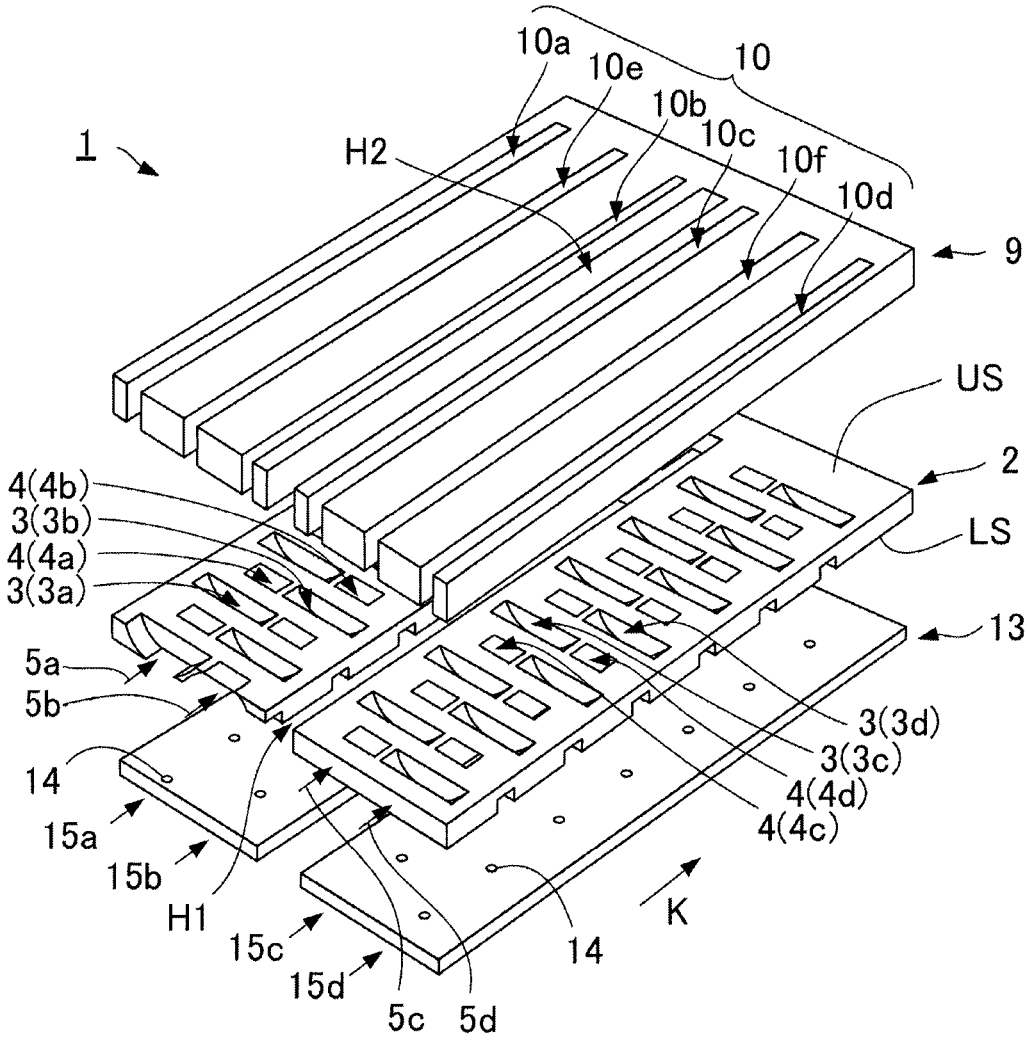
FIG. 3 is a schematic, partial exploded perspective view of the liquid jet head according to the third embodiment of the present invention.
Figure 4A:
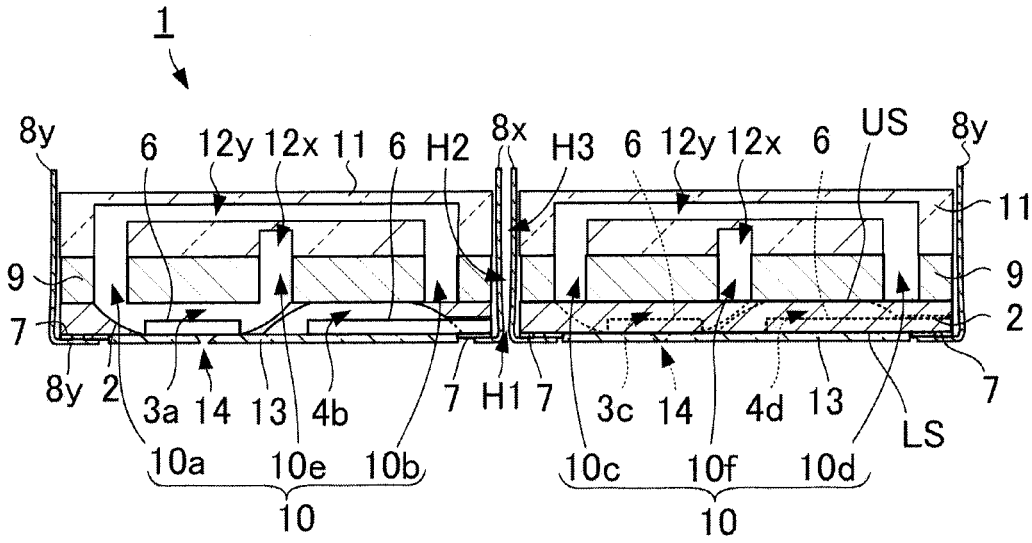
FIGS. 4A and 4B are explanatory drawings of the liquid jet head according to the third embodiment of the present invention.
Figure 4B:
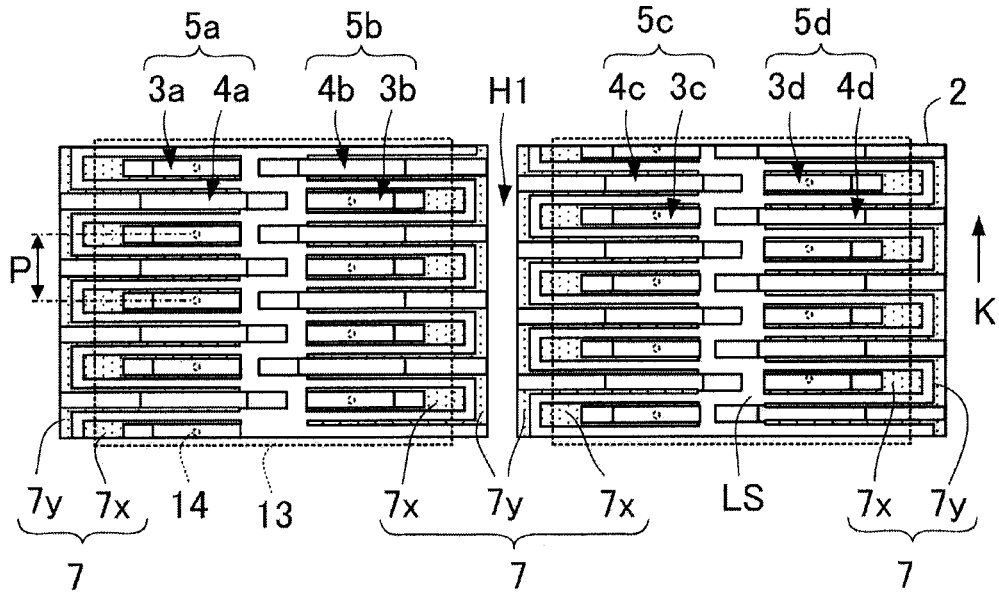

FIG. 3 is a schematic, partial exploded perspective view of a liquid jet head 1 according to the third embodiment of the present invention. FIGS. 4A and 4B are explanatory drawings of the liquid jet head 1 according to the third embodiment of the present invention. FIG. 4A is a schematic cross-sectional view along the groove length direction of the ejection grooves 3. FIG. 4B is a schematic plan view of the piezoelectric body substrate 2 as viewed from the lower surface LS side. In FIG. 4B, the flexible circuit boards 8 and the flow path plate 11 are omitted. The liquid jet head 1 of the third embodiment mainly differs from that of the first embodiment in that four groove arrays 5, a first groove array 5*a* to a fourth groove array 5*d*, are provided, and four nozzle arrays 15, a first nozzle array 15*a* to a fourth nozzle array 15*d*, corresponding thereto are provided, and that each of the groove arrays 5 has an arrangement in which the ejection grooves 3 and the non-ejection grooves 4 are alternately disposed to constitute the respective nozzle arrays 15. The same components or components having the same function are denoted by the same marks throughout the drawings.

As shown in FIG. 3, the liquid jet head 1 includes a cover plate 9 bonded to the upper surface US of the piezoelectric body substrate 2; a nozzle plate 13 bonded to the lower surface LS of the piezoelectric body substrate 2; and, as shown in FIG. 4A, flexible circuit boards 8*x* and 8*y* connected to the lower surface LS of the piezoelectric body substrate 2. The piezoelectric body substrate 2 includes ejection grooves 3 that are arrayed in the reference direction K, and non-ejection grooves 4 that penetrate from the upper surface US to the lower surface LS, and are arrayed in the reference direction K in alternation with the ejection grooves 3. The ejection grooves 3 and the non-ejection grooves 4 that are alternately arrayed in the reference direction K constitute the four groove arrays 5, the first groove array 5*a* to the fourth groove array 5*d*, arranged in parallel. The piezoelectric body substrate 2 further includes drive electrodes 6 provided on side faces of the ejection grooves 3 and the non-ejection grooves 4; terminal electrodes 7 provided on the lower surface LS, and electrically connected to the drive electrodes 6; and a first opening portion H1 penetrating from the upper surface US to the lower surface LS between the second groove array 5*b* and the third groove array 5*c*. The flexible circuit boards 8*x* are led out from the lower surface LS to the upper surface US of the piezoelectric body substrate 2 through the first opening portion H1.

The cover plate 9 includes liquid chambers 10 that communicate with the ejection grooves 3, and a second opening portion H2 that penetrates in the plate thickness direction. The flexible circuit boards 8*x* are led out upward through the first opening portion H1 and the second opening portion H2. The nozzle plate 13 includes nozzles 14 that respectively communicate with the ejection grooves 3. The nozzles 14 constitute four nozzle arrays 15, which are a first nozzle array 15*a* to a fourth nozzle array 15*d* respectively corresponding to the first groove array 5*a* to the fourth groove array 5*d*.

A more specific description is provided below. As shown in FIG. 4A, each of the ejection grooves 3 penetrating from the upper surface US to the lower surface LS of the piezoelectric body substrate 2 has a convex shape in a direction from the upper surface US to the lower surface LS, while each of the non-ejection grooves 4 has a convex shape in a direction from the lower surface LS to the upper surface US. Here, the ejection grooves 3 and the non-ejection grooves 4 included in the first groove array 5*a* are respectively designated as first ejection grooves 3*a* and first non-ejection grooves 4*a*; the ejection grooves 3 and the non-ejection grooves 4 included in the second groove array 5*b* are respectively designated as second ejection grooves 3*b* and second non-ejection grooves 4*b*; the ejection grooves 3 and the non-ejection grooves 4 included in the third groove array 5*c* are respectively designated as third ejection grooves 3*c* and third non-ejection grooves 4*c*; and the ejection grooves 3 and the non-ejection grooves 4 included in the fourth groove array 5*d* are respectively designated as fourth ejection grooves 3*d* and fourth non-ejection grooves 4*d*.

The first groove array 5*a* and the second groove array 5*b* adjacent to each other are arranged such that the end portion on the second groove array 5*b* side of a first ejection groove 3*a* included in the first groove array 5*a* disposed on one side, and the end portion on the first groove array 5*a* side of one, adjacent to that first ejection groove 3*a*, of the second non-ejection grooves 4*b* included in the second groove array 5*b* disposed on the other side are spaced apart from each other, and overlap with each other in the thickness direction of the piezoelectric body substrate 2. Moreover, the end portion on the one side of each of the first non-ejection grooves 4*a* included in the first groove array 5*a* is formed as a shallow groove having a straight shape, to the side face on the one side of the piezoelectric body substrate 2. The end portion on the other side of each of the second non-ejection grooves 4*b* included in the second groove array 5*b* is formed as a shallow groove having a straight shape, to a corresponding side face of the first opening portion H1. Each of the shallow grooves has a maximum depth from the lower surface LS that is more than half the thickness of the piezoelectric body substrate 2.

Similarly, the third groove array 5*c* and the fourth groove array 5*d* adjacent to each other are arranged such that the end portion on the fourth groove array 5*d* side of a third ejection groove 3*c* included in the third groove array 5*c* disposed on one side, and the end portion on the third groove array 5*c* side of one, adjacent to that third ejection groove 3*c*, of the fourth non-ejection grooves 4*d* included in the fourth groove array 5*d* disposed on the other side are spaced apart from each other, and overlap with each other in the thickness direction of the piezoelectric body substrate 2. Moreover, the end portion on the one side of each of the third non-ejection grooves 4*c* included in the third groove array 5*c* is formed as a shallow groove having a straight shape, to a corresponding side face of the first opening portion H1. The end portion on the other side of each of the fourth non-ejection grooves 4*d* included in the fourth groove array 5*d* is formed as a shallow groove having a straight shape, to the side face on the other side of the piezoelectric body substrate 2. Each of the shallow grooves has a maximum depth from the lower surface LS that is more than half the thickness of the piezoelectric body substrate 2. Such arrangement of the ejection grooves 3 and the non-ejection grooves 4 can reduce the widths of the first groove array 5*a* and of the second groove array 5*b* in the groove length direction, and the widths of the third groove array 5*c* and of the fourth groove array 5*d* in the groove length direction. Furthermore, formation of an end portion on one side of each of the non-ejection grooves 4 as a shallow groove allows the drive electrodes (not shown) formed on both side faces of each of the non-ejection grooves 4 to be connected to the terminal electrodes 7 in an electrically separated manner.

The first ejection grooves 3*a* included in the first groove array 5*a* are arrayed with a pitch P in the reference direction K. The second, the third, and the fourth ejection grooves 3*b*, 3*c*, and 3*d* respectively included in the second, the third, and the fourth groove arrays 5*b*, 5*c*, and 5*d* are arrayed with a pitch P in the reference direction K. The first ejection grooves 3*a* and the second ejection grooves 3*b* are shifted from each other by half the pitch P in the reference direction K. Similarly, the third ejection grooves 3*c* and the fourth ejection grooves 3*d* are shifted from each other by half the pitch P in the reference direction K. In addition, the second ejection grooves 3*b* and the third ejection grooves 3*c* shifted from each other by one quarter of the pitch P in the reference direction K. The result is that the first to the fourth ejection grooves 3*a* to 3*d* are arrayed with a pitch of one quarter of the pitch P in the reference direction K. Thus, recording density can be four times as high as that of one having only a single groove array 5.

The configuration relating to the drive electrodes 6 and the terminal electrodes 7 will now be described using FIG. 4B. As viewed from the lower surface LS of the piezoelectric body substrate 2, the ejection grooves 3 each having a shorter length in the groove length direction, and the non-ejection grooves 4 each having a longer length in the groove length direction are alternately arrayed in the reference direction K, thereby constitute the first to the fourth groove arrays 5*a* to 5*d*. The first opening portion H1 is provided at the center of the width in the groove length direction of the piezoelectric body substrate 2. One end portion of both end portions, in the groove length direction, of each of the non-ejection grooves 4 is formed as a shallow groove having a straight shape (see FIG. 4B). The first non-ejection grooves 4*a* of the first groove array 5*a* extend to a side face of the piezoelectric body substrate 2, and the second non-ejection grooves 4*b* of the second groove array 5*b* extend to a side face of the first opening portion H1. The third and the fourth non-ejection grooves 4*c* and 4*d* of the third and the fourth groove arrays 5*c* and 5*d* have similar configurations. The side faces of the ejection grooves 3 and the non-ejection grooves 4 are provided with the drive electrodes 6. The drive electrodes 6 are provided with its maximum depth from the lower surface LS being substantially half the thickness of the piezoelectric body substrate 2.

The first groove array 5*a* is arranged as follows. The terminal electrodes 7 are provided on the lower surface LS near a side face of the piezoelectric body substrate 2. The terminal electrodes 7 include common terminal electrodes 7*x* that are each electrically connected to the drive electrodes 6 provided on both side faces of each of the first ejection grooves 3*a*, and individual terminal electrodes 7*y* that are each electrically connected to the drive electrodes 6 provided on side faces of two of the first non-ejection grooves 4*a* interposing one of the first ejection grooves 3*a* therebetween. The individual terminal electrodes 7*y* are disposed on a side-face side of the piezoelectric body substrate 2, and the common terminal electrodes 7*x* are disposed closer to the first ejection grooves 3*a* than the individual terminal electrodes 7*y*. Both the common and the individual terminal electrodes 7*x* and 7*y* are exposed in regions where the flexible circuit boards 8*y* are connected. The second groove array 5*b* is arranged as follows. The terminal electrodes 7 include common terminal electrodes 7*x* that are each electrically connected to the drive electrodes 6 provided on both side faces of each of the second ejection grooves 3*b*, and individual terminal electrodes 7*y* that are each electrically connected to the drive electrodes 6 provided on side faces of two of the second non-ejection grooves 4*b* interposing one of the second ejection grooves 3*b* therebetween. The individual terminal electrodes 7*y* are disposed on an opening portion side of the first opening portion H1, and the common terminal electrodes 7*x* are disposed closer to the second ejection grooves 3*b* than the individual terminal electrodes 7*y*. Both the common and the individual terminal electrodes 7*x* and 7*y* are exposed in regions where the flexible circuit boards 8*x* is connected. The third groove array 5*c* and the fourth groove array 5*d* are arranged in a similar manner.

Then, the flexible circuit boards 8*y* is connected to regions for the terminal electrodes 7 (the common terminal electrodes 7*x* and the individual terminal electrodes 7*y*) of the first groove array 5*a* by thermal compression bonding, and the wiring pattern of that flexible circuit board By and the terminal electrodes 7 are electrically connected together. The flexible circuit boards 8*x* is drawn out through the second opening portion H2 and the first opening portion H1, and is connected to regions for the terminal electrodes 7 of the second groove array 5*b* by thermal compression bonding, and the wiring pattern (not shown) of that flexible circuit board 8*x* and the terminal electrodes 7 are electrically connected together. Similarly, in the third groove array 5*c* and in the fourth groove array 5*d* also, the flexible circuit boards 8*x* and 8*y* are connected to the lower surface LS, and the terminal electrodes 7 and the wiring patterns are electrically connected together.

The cover plate 9 includes the second opening portion H2 formed at the center of the width in the groove length direction; a first to a fourth liquid chambers 10*a* to 10*d*; and a first and a second common liquid chambers 10*e* and 10*f*. The first common liquid chamber 10*e* communicates with the end portions on the second groove array 5*b* side of the respective first ejection grooves 3*a* included in the first groove array 5*a*, and with the end portions on the first groove array 5*a* side of the respective second ejection grooves 3*b* included in the second groove array 5*b*. The first liquid chamber 10*a* communicates with the end portions on the other side of the respective first ejection grooves 3*a*; and the second liquid chamber 10*b* communicates with the end portions on the other side of the respective second ejection grooves 3*b*. Similarly, the second common liquid chamber 10*f* communicates with the end portions on the fourth groove array 5*d* side of the respective third ejection grooves 3*c* included in the third groove array 5*c*, and with the end portions on the third groove array 5*c* side of the respective fourth ejection grooves 3*d* included in the fourth groove array 5*d*. The third liquid chamber 10*c* communicates with the end portions on the other side of the respective third ejection grooves 3*c*; and the fourth liquid chamber 10*d* communicates with the end portions on the other side of the respective fourth ejection grooves 3*d*. The portions of the upper surface US of the piezoelectric body substrate 2 on which the liquid chambers 10 are provided have no openings for the non-ejection grooves 4. This eliminates the need to provide a slit that communicates with the ejection grooves 3 and blocks the non-ejection grooves 4. This greatly simplifies the configuration of the liquid chambers 10. Liquid may be circulated such that the liquid is injected into the first and the second common liquid chambers 10*e* and 10*f*, and drained from the first to the fourth liquid chambers 10*a* to 10*d*, or may be circulated in an opposite direction. Alternatively, liquid may be injected into all the liquid chambers 10.

The flow path plate 11 is bonded to an opposite surface of the piezoelectric body substrate 2 of the cover plate 9. The flow path plate 11 includes a supply flow path 12*x*, a discharge flow path 12*y*, and a third opening portion H3. The third opening portion H3 penetrates in the plate thickness direction of the flow path plate 11. The flexible circuit boards 8*x* are led out upward through the third opening portion H3. The supply flow path 12*x* communicates with the first common liquid chamber 10*e* and the second common liquid chamber 10*f* of the cover plate 9, and the discharge flow path 12*y* communicates with the first to the fourth liquid chambers 10*a* to 10*d*. That is, liquid is supplied from the supply flow path 12*x* to the piezoelectric body substrate 2 side, and is discharged from the discharge flow path 12*y*. Alternatively, liquid may be circulated in an opposite direction.

The nozzle plate 13 includes a first to a fourth nozzle arrays 15*a* to 15*d*, in each of which the nozzles 14 communicating with the ejection grooves 3 are arrayed in the reference direction K. The nozzle plate 13 is bonded to the lower surface LS of the piezoelectric body substrate 2. The nozzle plate 13 is bonded to the lower surface LS in one step, and thereafter, the regions of the nozzle plate 13 are removed where the terminal electrodes 7 are formed and the flexible circuit boards 8 are connected thereto, and where the first opening portion H1 is formed. That is, the nozzle arrays 15 can be aligned at one time.

Thus, provision of the first opening portion H1 in the piezoelectric body substrate 2 allows the terminal electrodes 7, which are connected to three or more groove arrays 5, and an external circuit to be easily electrically connected together. Moreover, since the drive electrodes 6 and the individual terminal electrodes 7*y* provided for the non-ejection grooves 4 contact with no liquid, leakage of an external drive signal through liquid does not occur, nor does electrolysis of liquid occur on surfaces of the drive electrodes 6 which cause disconnection or the like. Furthermore, the configuration in which, on a portion between the first groove array 5*a* and the second groove array 5*b*, the end portions of adjacent ones of the first ejection grooves 3*a* and the second non-ejection grooves 4*b* overlap with each other, and the end portions of adjacent ones of the second ejection grooves 3*b* and the first non-ejection grooves 4*a* overlap with each other, in the plate thickness direction of the piezoelectric body substrate 2, and in which the first common liquid chamber 10*e* communicates with both the first ejection grooves 3*a* and the second ejection grooves 3*b* allows the width in the groove length direction to be significantly reduced. A similar argument applies to the third groove array 5*c* and the fourth groove array 5*d*.

Note that, in the present invention, the shapes of the ejection grooves 3 and of the non-ejection grooves 4, the positions of the first ejection grooves 3*a* to the fourth ejection grooves 3*d* in the reference direction K, or the like, are not limited to those of this embodiment. Moreover, this embodiment has been presented in which, of the terminal electrodes 7 provided on the lower surface LS of the piezoelectric body substrate 2, each of the common terminal electrodes 7*x* is led out to a side-face side or a first opening portion H1 side of the piezoelectric body substrate 2 depending on which of a first ejection groove 3*a* or a second ejection groove 3*b* is related, but the present invention is not limited to this configuration. For example, the configuration may be such that the spacing between the first groove array 5*a* and the second groove array 5*b* is increased; each of the common terminal electrodes 7*x* for the first ejection grooves 3*a* and for the second ejection grooves 3*b* is led out to a portion of the lower surface LS between the first groove array 5*a* and the second groove array 5*b* to form a common electrode; and the common electrode is drawn out to a portion near an edge, of the lower surface LS, in the reference direction K of the piezoelectric body substrate 2, and is then electrically connected to the wiring pattern of a corresponding one of the flexible circuit boards 8*y* or 8*x*. Similarly, the configuration may be such that the spacing between the third groove array 5*c* and the fourth groove array 5*d* is increased; each of the common terminal electrodes 7*x* for the third ejection grooves 3*c* and for the fourth ejection grooves 3*d* is led out to a portion of the lower surface LS between the third groove array 5*c* and the fourth groove array 5*d* to form a common electrode; and the common electrode is drawn out to a portion near an edge, of the lower surface LS, in the reference direction K of the piezoelectric body substrate 2, and is then electrically connected to the wiring pattern of a corresponding one of the flexible circuit boards 8*y* or 8*x*. This increases the array pitch of the terminal electrodes 7, thereby making easier the connection to the wiring patterns of the flexible circuit boards 8.

Fourth Embodiment

Figure 5:
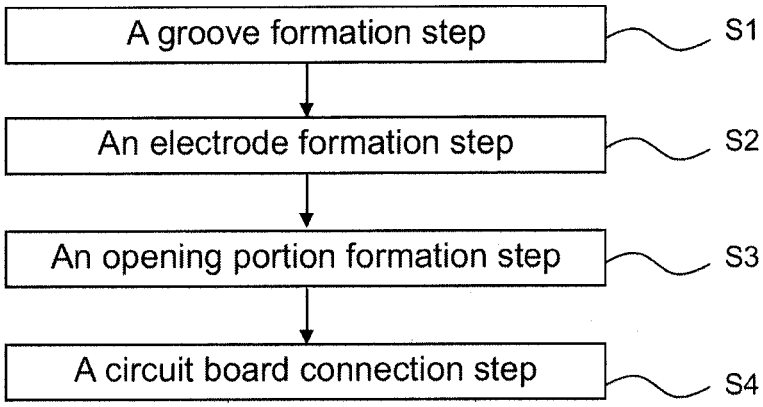
FIG. 5 is a process chart illustrating the method of manufacturing a liquid jet head according to the fourth embodiment of the present invention.

FIG. 5 and FIGS. 6S1 to 6S4 are drawings for explaining the method of manufacturing a liquid jet head 1 according to the fourth embodiment of the present invention. FIG. 5 is a process chart illustrating the method of manufacturing a liquid jet head 1 according to the fourth embodiment of the present invention. FIGS. 6S1 to 6S4 are drawings for explaining the respective steps of the fourth embodiment of the present invention. This embodiment discusses a basic method of manufacturing a liquid jet head of the present invention. The same components or components having the same function are denoted by the same marks throughout the drawings.

The method of manufacturing a liquid jet head 1 of the present invention includes a groove formation step S1 of forming a plurality of groove arrays in the piezoelectric body substrate 2; an electrode formation step S2 of forming electrodes on the piezoelectric body substrate 2; an opening portion formation step S3 of penetrating the first opening portion H1 between two of the groove arrays 5 of the piezoelectric body substrate 2; and a circuit board connection step S4 of connecting the flexible circuit boards 8 through the first opening portion H1 to the lower surface LS of the piezoelectric body substrate 2. Thus, an increase in the number of the groove arrays still allows a drive signal to be easily supplied from an external circuit to the respective groove arrays 5. Each of the steps will now be described in detail with reference to FIGS. 6S1 to 6S4.

As shown in FIG. 6S1, the groove formation step S1 is performed such that the piezoelectric body substrate 2 is cut using a dicing blade 20 to form a plurality of groove arrays 5, in each of which the ejection grooves 3 are arrayed in the reference direction K. The piezoelectric body substrate 2 can be made using a PZT ceramic material. In FIGS. 6S1 to 6S4, two groove arrays 5 (i.e., the first groove array 5*a* and the second groove array 5*b*) are formed in parallel along the reference direction K (i.e., the direction into the paper). Note that the grooves may be formed in such a manner that first the grooves are formed from the upper surface US toward the lower surface LS using a dicing blade 20 so as not to penetrate, and the piezoelectric body substrate 2 is then cut from the lower surface LS to make the grooves penetrate. Moreover, as described later in this specification, the ejection grooves 3 and the non-ejection grooves 4 may be alternately formed in the reference direction K.

As shown in FIG. 6S2, the electrode formation step S2 is performed such that the drive electrodes 6 are formed on side faces of the ejection grooves 3, and the terminal electrodes 7 are formed on the lower surface LS of the piezoelectric body substrate 2. The drive electrodes 6 are provided with its maximum depth from the lower surface LS being substantially half the plate thickness of the piezoelectric body substrate 2. The terminal electrodes 7 are formed both on one side and on the other side along the groove length direction across the ejection grooves 3. For example, the terminal electrodes 7 on the one side are provided on the lower surface LS close to the outer periphery of the piezoelectric body substrate 2, and the terminal electrodes 7 on the other side are provided in a center portion of the lower surface LS of the piezoelectric body substrate 2. For example, the first groove array 5*a* is arranged such that the terminal electrodes 7 on the one side are electrically connected to the drive electrodes 6 provided on side faces on one side of the respective first ejection grooves 3*a*, and the terminal electrodes 7 on the other side are electrically connected to the drive electrodes 6 provided on side faces on the other side of the respective first ejection grooves 3*a*. The terminal electrodes 7 on the second groove array 5*b* side are formed in a similar manner. The drive electrodes 6 and the terminal electrodes 7 can be formed at one time by, for example, depositing metal, such as aluminum, nickel, gold, silver, or the like, on a patterned resist on the lower surface LS, from the lower surface LS side, using an oblique vapor deposition process, and subsequently removing the resist using a lift-off technique.

Note that this embodiment employs a piezoelectric body substrate 2 that is polarized in one direction normal to a surface. When a piezoelectric body substrate 2 of a chevron type is used instead, the maximum depth of the drive electrodes 6 from the lower surface LS needs to be beyond the polarization boundary of the piezoelectric body substrate.

As shown in FIG. 6S3, the opening portion formation step S3 is performed such that a portion between the first groove array 5*a* and the second groove array 5*b* adjacent to each other is cut through to form the first opening portion H1 that penetrates from the upper surface US to the lower surface LS of the piezoelectric body substrate 2. The first opening portion H1 can be formed using the dicing blade 20, a sandblasting technique, or the like. Next, as shown in FIG. 6S4, the circuit board connection step S4 is performed such that the flexible circuit boards 8*x* on which wiring patterns (not shown) are formed are drawn out through the first opening portion H1, and are connected to the lower surface LS of the piezoelectric body substrate 2 so that the wiring patterns and the terminal electrodes 7 closer to the first opening portion H1 are electrically connected together. Also, the flexible circuit boards 8*y* on which wiring patterns are formed are connected to the lower surface LS so that the wiring patterns and the terminal electrodes 7 closer to the outer periphery of the piezoelectric body substrate 2 are electrically connected together.

As described above, formation of the first opening portion H1 between two of the plurality of groove arrays 5 allows the flexible circuit boards 8 electrically connected to the terminal electrodes 7 to be easily led out to an opposite side of the piezoelectric body substrate 2 from the surface on which the terminal electrodes 7 are formed even when three or more groove arrays 5 are formed.

Note that when the liquid jet head 1 is fabricated in practice, the cover plate 9 is bonded to the upper surface US after the groove formation step S1, and the nozzle plate 13 is bonded to the lower surface LS of the piezoelectric body substrate 2 before or after the circuit board connection step S4. Moreover, during the opening portion formation step S3, the second opening portion H2 can be formed in the cover plate 9 at the same time as the formation of the first opening portion H1 in the piezoelectric body substrate 2. Then, in the circuit board connection step S4, the flexible circuit boards 8 can be connected to the lower surface LS through both the first opening portion H1 and the second opening portion H2.

Fifth Embodiment

Figure 7:
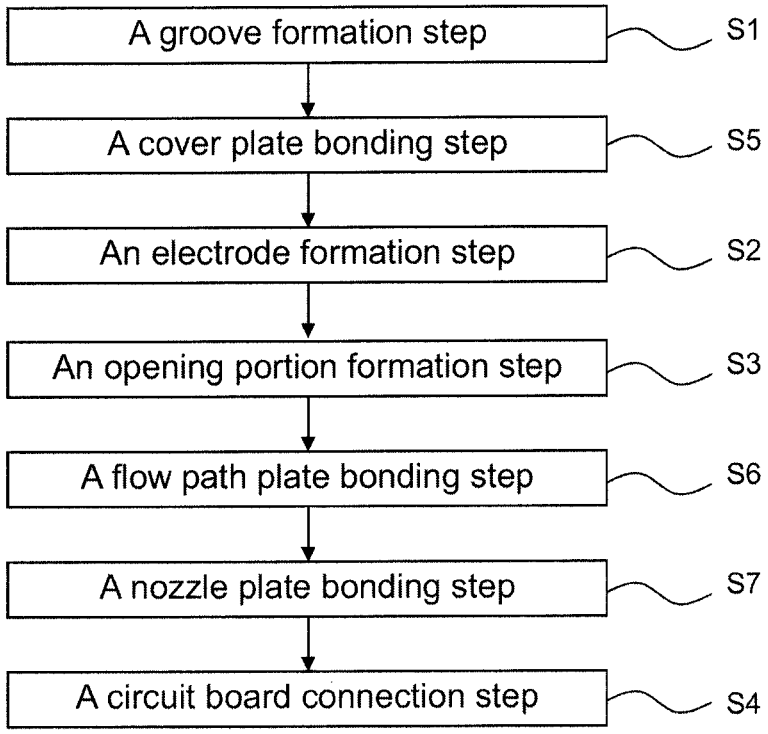
FIG. 7 is a process chart illustrating the method of manufacturing a liquid jet head according to the fifth embodiment of the present invention.
Figure 8:
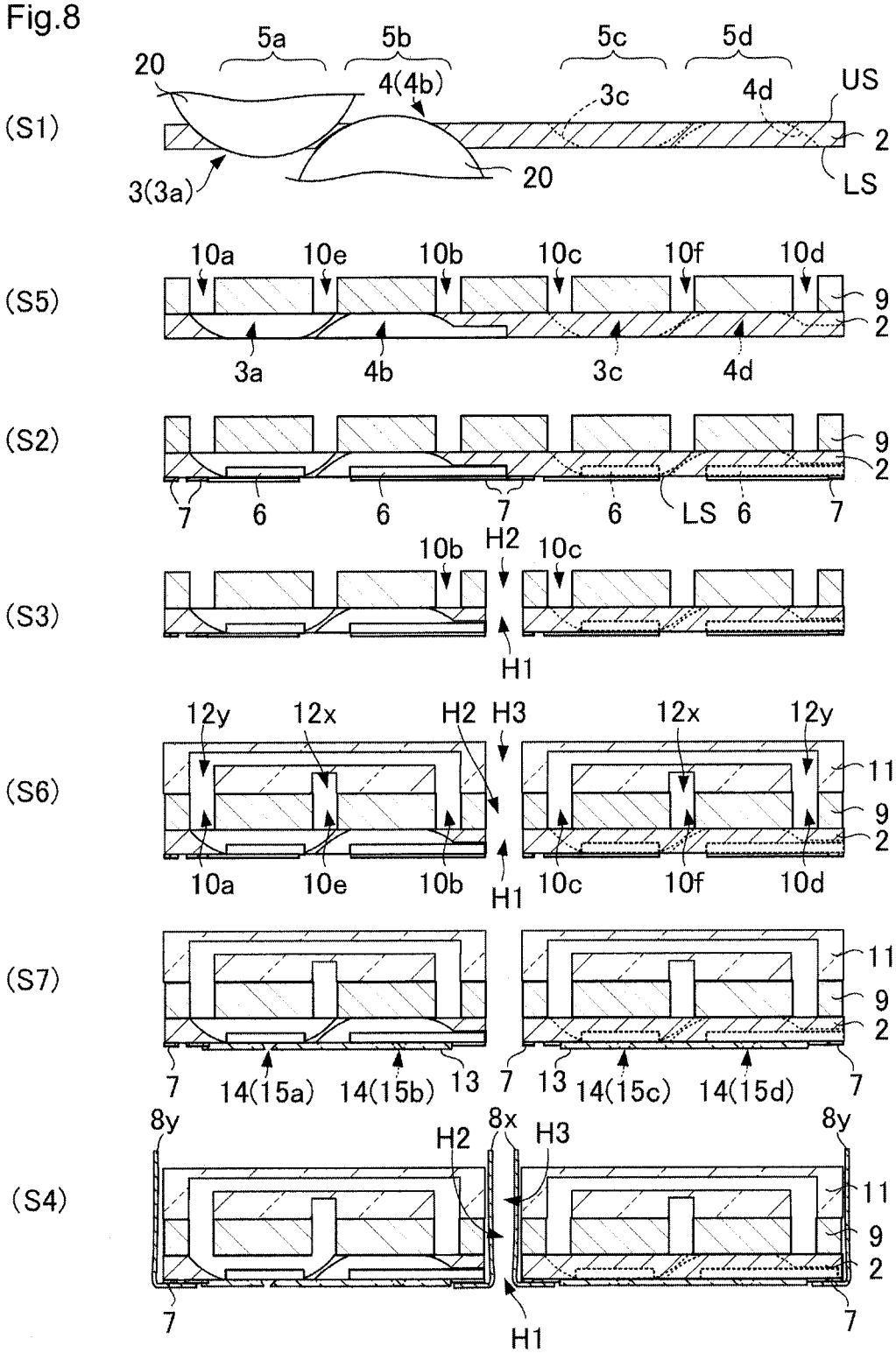

FIG. 7 and FIGS. 8S1 to 8S4 are drawings for explaining the method of manufacturing a liquid jet head 1 according to the fifth embodiment of the present invention. FIG. 7 is a process chart illustrating the method of manufacturing a liquid jet head 1 according to the fifth embodiment of the present invention. FIGS. 8S1 to 8S4, as in the illustrated order, are drawings for explaining the respective steps of the fifth embodiment of the present invention. This embodiment discusses an example in which four groove arrays 5 (i.e., the first groove array 5*a* to the fourth groove array 5*d*) are formed; each of the groove arrays 5 includes the ejection grooves 3 and the non-ejection grooves 4 alternately arrayed in the reference direction K; and the first opening portion H1 is formed between the second groove array 5*b* and the third groove array 5*c* in the piezoelectric body substrate 2. The same components or components having the same function are denoted by the same marks throughout the drawings.

As shown in FIG. 7, the method of manufacturing a liquid jet head 1 of this embodiment includes a groove formation step S1, a cover plate bonding step S5, an electrode formation step S2, an opening portion formation step S3, a flow path plate bonding step S6, a nozzle plate bonding step S7, and a circuit board connection step S4. Each of the steps will be described below in detail in the order of performance.

As shown in FIG. 8S1, the groove formation step S1 is performed such that the piezoelectric body substrate 2 is cut to form the first to the fourth groove arrays 5*a* to 5*d*, in each of which the ejection grooves 3 and the non-ejection grooves 4 are alternately arrayed in the reference direction K. More specifically, the groove formation step S1 includes an ejection groove formation step S11, which cuts the piezoelectric body substrate 2 from the upper surface US to form the first to the fourth ejection grooves 3*a* to 3*d*; and a non-ejection groove formation step S12, which cuts the piezoelectric body substrate 2 from the lower surface LS to form the first to the fourth non-ejection grooves 4*a* to 4*d*. In the non-ejection groove formation step S12, the end portion, on the side opposite the second groove array 5*b*, of each of the first non-ejection grooves 4*a* is formed as a shallow groove having a straight shape, to one side face of the piezoelectric body substrate 2; the end portion on the third groove array 5*c* side of each of the second non-ejection grooves 4*b* is formed as a shallow groove having a straight shape, to the center of the width in the groove length direction of the piezoelectric body substrate 2; the end portion on the second groove array 5*b* side of each of the third non-ejection grooves 4*c* is formed as a shallow groove having a straight shape, to the center of the width in the groove length direction; and the end portion, on the side opposite the third groove array 5*c*, of each of the fourth non-ejection grooves 4*d* is formed as a shallow groove having a straight shape, to the other side face of the piezoelectric body substrate 2.

Here, the first ejection grooves 3*a* of the first groove array 5*a* and the second ejection grooves 3*b* of the second groove array 5*b* are formed so as to be shifted from each other by half the pitch in the reference direction K. Similarly, the third ejection grooves 3*c* of the third groove array 5*c* and the fourth ejection grooves 3*d* of the fourth groove array 5*d* are formed so as to be shifted from each other by half the pitch in the reference direction K. Moreover, the second ejection grooves 3*b* of the second groove array 5*b* and the third ejection grooves 3*c* of the third groove array 5*c* are formed so as to be shifted from each other by one quarter of the pitch in the reference direction K. Thus, the ejection grooves 3 of each of the groove arrays 5 are arrayed equidistantly with an array pitch of one quarter of the pitch when viewed from the groove length direction, and thus recording density is four times as high as that of one having only a single groove array.

Furthermore, adjacent ones of the first ejection grooves 3*a* and the second non-ejection grooves 4*b*, and adjacent ones of the first non-ejection grooves 4*a* and the second ejection grooves 3*b* are arranged in lines in the groove length direction. Similarly, adjacent ones of the third ejection grooves 3*c* and the fourth non-ejection grooves 4*d*, and adjacent ones of the third non-ejection grooves 4*c* and the fourth ejection grooves 3*d* are arranged in lines in the groove length direction. In addition, adjacent ones of the first ejection grooves 3*a* and the second non-ejection grooves 4*b* can be formed so as to be spaced apart from each other, and partially overlap with each other in the plate thickness direction of the piezoelectric body substrate 2; and adjacent ones of the first non-ejection grooves 4*a* and the second ejection grooves 3*b* can be formed so as to be spaced apart from each other, and partially overlap with each other in the plate thickness direction of the piezoelectric body substrate 2. Similarly, adjacent ones of the third ejection groove 3*c* and the fourth non-ejection groove 4*d* can be formed so as to be spaced apart from each other, and partially overlap with each other in the plate thickness direction of the piezoelectric body substrate 2; and adjacent ones of the third non-ejection groove 4*c* and the fourth ejection groove 3*d* can be formed so as to be spaced apart from each other, and partially overlap with each other in the plate thickness direction of the piezoelectric body substrate 2. Such arrangement can reduce the spacing between the first groove array 5*a* and the second groove array 5*b*, and the spacing between the third groove array 5*c* and the fourth groove array 5*d*, and the entirety of the liquid jet head 1 can thus be arranged in a compact manner. Note that the first to the fourth non-ejection grooves 4*a* to 4*d* may be constituted so as not to open through the upper surface US of the piezoelectric body substrate 2.

As shown in FIG. 8S5, the cover plate bonding step S5 is performed such that the cover plate 9 in which liquid chambers 10 are formed is bonded to the upper surface US of the piezoelectric body substrate 2 so that the liquid chambers 10 and the ejection grooves 3 communicate with each other. A more specific description is provided below. The cover plate 9 includes a first common liquid chambers 10*e*, a first liquid chamber 10*a* and a second liquid chamber 10*b* disposed across, and spaced apart from, the first common liquid chambers 10*e*, a second common liquid chambers 10*f*, and a third liquid chamber 10*c* and a fourth liquid chamber 10*d* disposed across, and spaced apart from, the second common liquid chambers 10*f*. The first liquid chamber 10*a* communicates with the end portions on one side of the first ejection grooves 3*a*. The first common liquid chamber 10*e* communicates with both the end portions on the other side of the first ejection grooves 3*a* and the end portions on the one side of the second ejection grooves 3*b*. The second liquid chamber 10*b* communicates with the end portions on the other side of the second ejection grooves 3*b*. The third liquid chamber 10*c* communicates with the end portions on the one side of the third ejection grooves 3*c*. The second common liquid chambers 10*f* communicates with both the end portions on the other side of the third ejection grooves 3*c* and the end portions on the one side of the fourth ejection grooves 3*d*. The fourth liquid chamber 10*d* communicates with the end portions on the other side of the fourth ejection grooves 3*d*. Note that none of the first to the fourth non-ejection grooves 4*a* to 4*d* opens into opening regions formed on the piezoelectric body substrate 2 side of the first and the second common liquid chambers 10*e* and 10*f*, and of the first to the fourth liquid chambers 10*a* to 10*d*.

As shown in FIG. 8S2, the electrode formation step S2 is performed such that the drive electrodes 6 are formed on both side faces of the ejection grooves 3 and of the non-ejection grooves 4, and the terminal electrodes 7 are formed on the lower surface LS of the piezoelectric body substrate 2. The drive electrodes 6 and the terminal electrodes 7 can be formed at one time by depositing metal, such as aluminum, nickel, gold, silver, on a patterned resist on the lower surface LS, from the lower surface LS side, using an oblique vapor deposition process, and subsequently removing the resist using a lift-off technique. The drive electrodes 6 are formed with its maximum depth from the lower surface LS being substantially half the thickness of the piezoelectric body substrate 2 when the piezoelectric body substrate 2 is uniformly polarized in a direction normal to the upper surface US or to the lower surface LS. Alternatively, when the piezoelectric body substrate 2 is of a chevron type, the maximum depth of the drive electrodes 6 from the lower surface LS needs to be beyond the polarization boundary of the piezoelectric body substrate 2. The terminal electrodes 7 formed on the lower surface LS of the piezoelectric body substrate 2 are similar to those shown in FIG. 4B of the third embodiment.

As shown in FIG. 8S3, the opening portion formation step S3 is performed such that a portion between the second groove array 5*b* and the third groove array 5*c* adjacent to each other of the piezoelectric body substrate 2 is cut through to form the first opening portion H1 from the upper surface US to the lower surface LS of the piezoelectric body substrate 2, and at the same time, the second opening portion H2 that penetrates, in the plate thickness direction, a portion between the second liquid chamber 10*b* and the third liquid chamber 10*c* adjacent to each other of the cover plate 9. This allows the first opening portion H1 and the second opening portion H2 to be formed in a single cutting step. Alternatively, the process may be performed in such a way that the second opening portion H2 penetrating, in the plate thickness direction, a portion between the second liquid chamber 10*b* and the third liquid chamber 10*c* adjacent to each other is formed in the cover plate 9 in advance, and only the first opening portion H1 is formed in the opening portion formation step S3.

Figure 6:
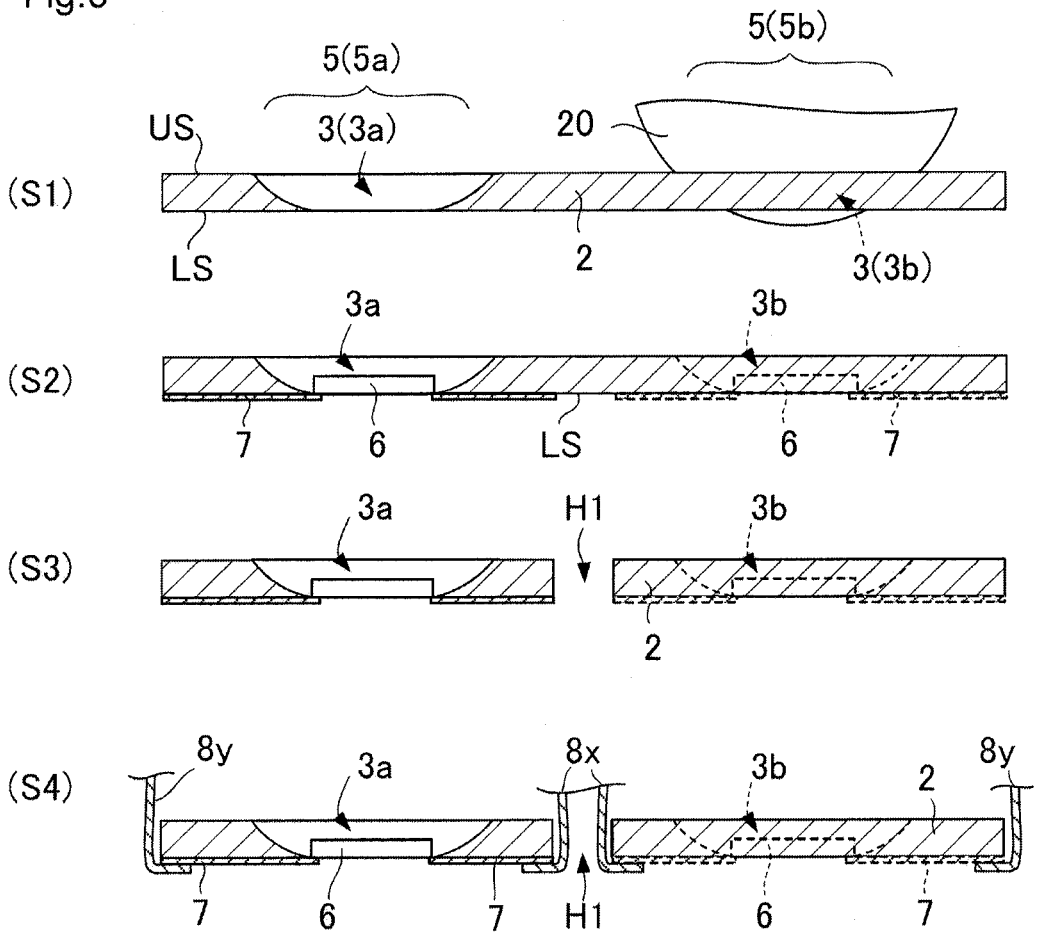

As shown in FIG. 8S6, the flow path plate bonding step S6 is performed such that the flow path plate 11 is bonded to an opposite surface of the piezoelectric body substrate 2 of the cover plate 9. The flow path plate 11 includes the third opening portion H3 that penetrates in the plate thickness direction, and which is arranged so as to communicate with the second opening portion H2 of the cover plate 9 during the bonding process. Moreover, the flow path plate 11 includes a supply flow path 12*x* and a discharge flow path 12*y*. The supply flow path 12*x* communicates with the first common liquid chamber 10*e* and the second common liquid chamber 10*f* of the cover plate 9, and the discharge flow path 12*y* communicates with the first to the fourth liquid chambers 10*a* to 10*d*. Note that the process may be performed in such a way that a flow path plate 11 in which the third opening portion H3 has not yet been formed is bonded to an opposite surface of the piezoelectric body substrate 2 of the cover plate 9, and the flow path plate 11 is then cut to form the third opening portion H3 penetrating in the plate thickness direction, at the same time as the formation of the first opening portion H1 and the second opening portion H2.

As shown in FIG. 8S7, the nozzle plate bonding step S7 is performed such that a nozzle plate 13 is bonded to the lower surface LS of the piezoelectric body substrate 2. The nozzle plate 13 needs to have nozzles 14 opened in advance at the positions respectively corresponding to the first to the fourth ejection grooves 3*a* to 3*d*, and thus to have the first to the fourth nozzle arrays 15*a* to 15*d* formed. The nozzle plate 13 is then bonded to the lower surface LS, after which the nozzle plate 13 is cut to expose the portions of the piezoelectric body substrate 2 where the terminal electrodes 7 are formed. This can align, in a single step, each of the ejection grooves 3 of the four arrays of the first to the fourth groove arrays 5*a* to 5*d* and each of the nozzles 14 of the four arrays of the first to the fourth nozzle arrays 15*a* to 15*d*. Note that the cutting process of the nozzle plate 13 may be omitted by firstly bonding the nozzle plate 13 to the lower surface LS and then opening the nozzles 14, or by bonding a nozzle plate 13 to the lower surface LS for each of the nozzle arrays 15.

As shown in FIG. 8S4, the circuit board connection step S4 is performed such that the flexible circuit boards 8*x* on which wiring patterns are formed are drawn out through the first to the third opening portions H1 to H3, and are connected to the lower surface LS of the piezoelectric body substrate 2 so that the wiring patterns and the terminal electrodes 7 are electrically connected together. Thus, the space on the lower surface LS side of the piezoelectric body substrate 2 is widely free. This allows the terminal electrodes 7 and the wiring patterns to be connected at one time by interposing an anisotropic electrically conductive material between the lower surface LS and each of the flexible circuit boards 8, and making crimp contacts contact therewith from backsides of the flexible circuit boards 8.

Note that the groove formation step S1 may be performed such that the ejection grooves 3 are formed so as not to penetrate from the upper surface US to the lower surface LS, and the cover plate bonding step S5 may be performed such that after bonding such cover plate 9 to the piezoelectric body substrate 2, the lower surface LS of the piezoelectric body substrate 2 is cut through to allow the ejection grooves 3 to open. In the cover plate bonding step S5, since the piezoelectric body material remains on the bottoms of the ejection grooves 3, chipping and/or a similar defect can be avoided on bottom-side portions of the ejection grooves 3. Moreover, the opening portion formation step S3 may be performed after the flow path plate bonding step S6, or after the nozzle plate bonding step S7. The described embodiments are presented in which adjacent ones of the ejection grooves 3 and the non-ejection grooves 4 are formed so as to partially overlap with each other in the thickness direction between the first groove array 5*a* and the second groove array 5*b* and between the third groove array 5*c* and the fourth groove array 5*d*. However, the present invention is not limited to this configuration, but adjacent ones of the ejection grooves 3 and the non-ejection grooves 4 may be spaced apart from each other so as not to overlap with each other in the thickness direction. Furthermore, the number of arrays of the groove arrays 5 may be more than four, and the number of opening portions that penetrate from the upper surface US to the lower surface LS of the piezoelectric body substrate 2 may be increased accordingly.

Sixth Embodiment

Figure 9:
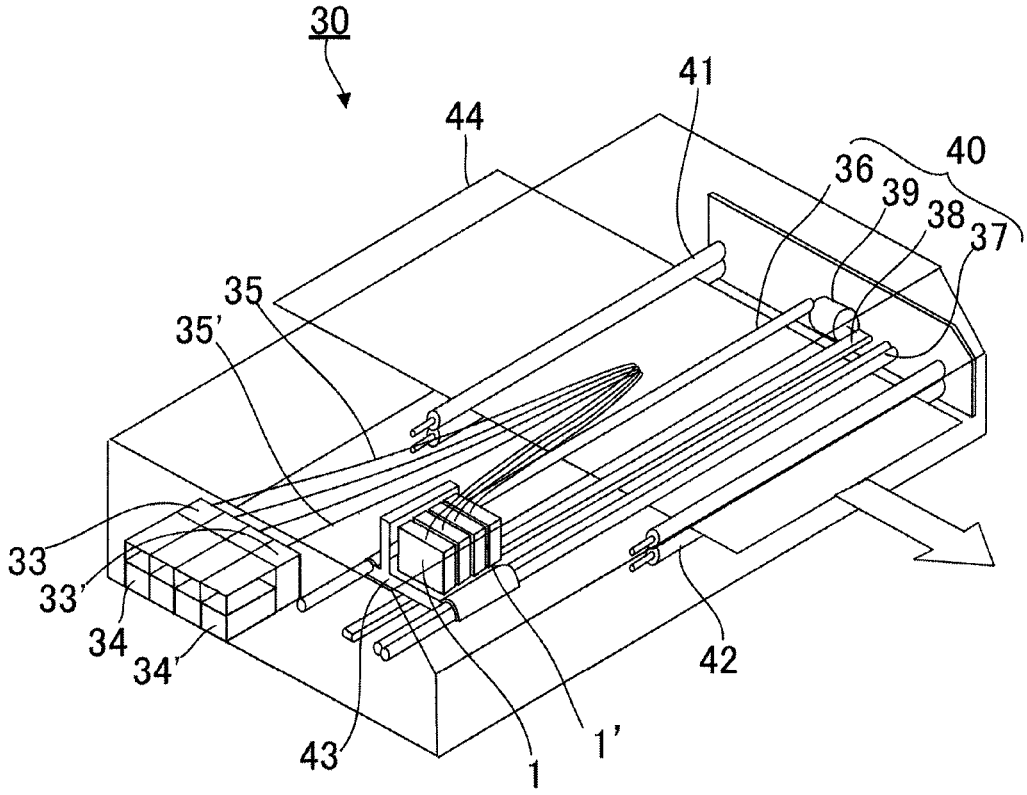
FIG. 9 is a schematic perspective view of the liquid jet apparatus according to the sixth embodiment of the present invention.
Figure 10:
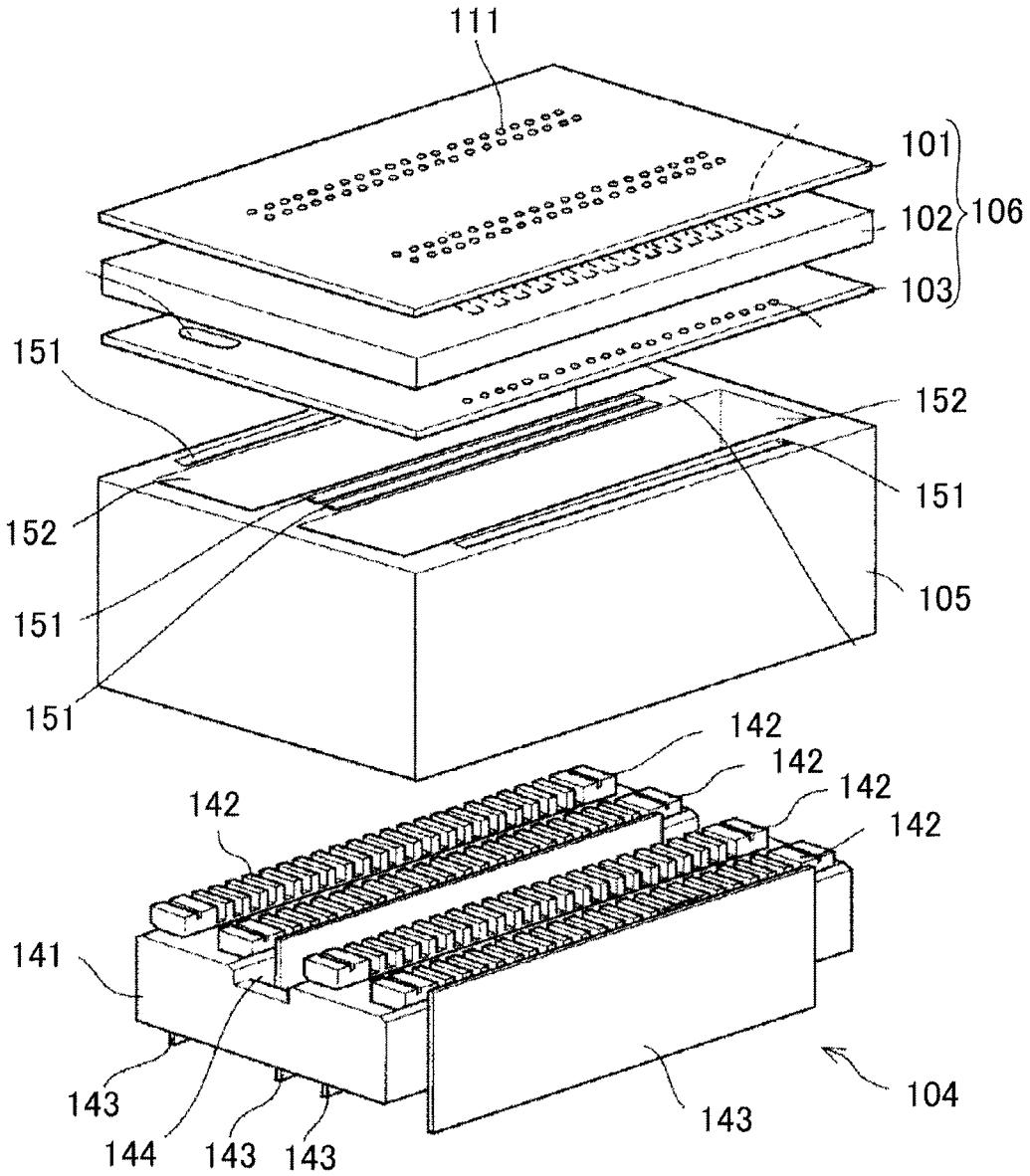
Fig.10 Prior art
FIG. 10 is an exploded perspective view of a conventionally known liquid jet head.

FIG. 9 is a schematic perspective view of the liquid jet apparatus 30 according to the sixth embodiment of the present invention. The liquid jet apparatus 30 is provided with a movement mechanism 40 which reciprocates liquid jet heads 1 and 1', flow path sections 35 and 35' which respectively supply liquid to the liquid jet heads 1 and 1' and discharge liquid from the liquid jet heads 1 and 1', and liquid pumps 33 and 33' and liquid tanks 34 and 34' which respectively communicate with the flow path sections 35 and 35'. Each of the liquid jet heads 1 and 1' includes a plurality of groove arrays. The end portion on one side of an ejection groove included in a groove array on the other side and the end portion on the other side of one, adjacent to that ejection groove, of the non-ejection grooves included in another groove array on the one side are spaced apart from each other, and overlap with each other in the thickness direction of the piezoelectric body substrate. The liquid jet heads 1 and 1' are each one of those described above in the first to the fifth embodiments.

The liquid jet apparatus 30 is provided with a pair of conveyance units 41 and 42 which conveys a recording medium 44 such as paper in a main scanning direction, the liquid jet heads 1 and 1' each of which ejects liquid onto the recording medium 44, a carriage unit 43 on which the liquid jet heads 1 and 1' are loaded, the liquid pumps 33 and 33' which respectively supply liquid stored in the liquid tanks 34 and 34' to the flow path sections 35 and 35' by pressing, and the movement mechanism 40 which moves the liquid jet heads 1 and 1' in a sub-scanning direction that is perpendicular to the main scanning direction. A control unit (not shown) controls the liquid jet heads 1 and 1', the movement mechanism 40, and the conveyance units 41 and 42 to drive.

Each of the pair of conveyance units 41 and 42 extends in the sub-scanning direction, and includes a grid roller and a pinch roller which rotate with the roller surfaces thereof making contact with each other. The grid roller and the pinch roller are rotated around the respective shafts by a motor (not shown) to thereby convey the recording medium 44, which is sandwiched between the rollers, in the main scanning direction. The movement mechanism 40 includes a pair of guide rails 36 and 37 extending in the sub-scanning direction, the carriage unit 43 slidable along the pair of guide rails 36 and 37, an endless belt 38 that is connected to and moves the carriage unit 43 in the sub-scanning direction, and a motor 39 that rotates the endless belt 38 via a pulley (not shown).

The carriage unit 43 loads the plurality of liquid jet heads 1 and 1' thereon. The liquid jet heads 1 and 1' eject, for example, liquid droplets of four colors including yellow, magenta, cyan, and black. Each of the liquid tanks 34 and 34' stores liquid of corresponding color, and supplies the stored liquid to each of the liquid jet heads 1 and 1' through each of the liquid pumps 33 and 33' and each of the flow path sections 35 and 35'. Each of the liquid jet heads 1 and 1' ejects liquid droplets of corresponding color in response to a driving signal. Any patterns can be recorded on the recording medium 44 by controlling the timing of ejecting liquid from the liquid jet heads 1 and 1', the rotation of the motor 39 for driving the carriage unit 43, and the conveyance speed of the recording medium 44.

In the liquid jet apparatus 30 of the present embodiment, the movement mechanism 40 moves the carriage unit 43 and the recording medium 44 to perform recording. Alternatively, however, the liquid jet apparatus may have a configuration in which a carriage unit is fixed, and a movement mechanism two-dimensionally moves a recording medium to perform recording. That is, the movement mechanism may have any configuration as long as it can relatively move a liquid jet head and a recording medium.

What is claimed is:

1. A liquid jet head comprising:

a piezoelectric body substrate having an upper surface and a lower surface, a plurality of groove arrays arranged in parallel along a reference direction, each of the plurality of groove arrays having ejection grooves penetrating from the upper surface to the lower surface and being arrayed in the reference direction, a first opening portion that penetrates from the upper surface to the lower surface between two of the plurality of groove arrays, drive electrodes provided on side faces of the ejection grooves, and terminal electrodes provided on the lower surface and electrically connected to the drive electrodes; and a flexible circuit board electrically connected to the terminal electrodes and connected to the lower surface of the piezoelectric body substrate, the flexible circuit board being led out from the lower surface to the upper surface through the first opening portion of the piezoelectric body substrate.

2. The liquid jet head according to claim 1, further comprising:

a cover plate having a liquid chamber configured to communicate with the ejection grooves, the cover plate being bonded to the upper surface of the piezoelectric body substrate, wherein the cover plate includes a second opening portion that penetrates in a plate thickness direction, and wherein the flexible circuit board is led out through the second opening portion.

3. The liquid jet head according to claim 2, further comprising:

a flow path plate bonded to a surface of the cover plate, the flow path plate having flow paths that communicate with the liquid chamber, wherein the flow path plate includes a third opening portion that penetrates from a cover plate side to a side opposite the cover plate, and wherein the flexible circuit board is led out through the third opening portion.

4. The liquid jet head according to claim 3, wherein the cover plate has a first surface bonded to the upper surface of the piezoelectric body substrate and a second surface opposite to the first surface and to which the flow path plate is bonded.

5. The liquid jet head according to claim 1, wherein each of the plurality of groove arrays of the piezoelectric body substrate has non-ejection grooves that penetrate from the upper surface to the lower surface of the piezoelectric body substrate, the non-ejection grooves being alternately arrayed with the ejection grooves in the reference direction; and wherein the piezoelectric body substrate further includes drive electrodes provided on side faces of the non-ejection grooves.

6. The liquid jet head according to claim 5, wherein:

the plurality of groove arrays of the piezoelectric body substrate comprises first to fourth groove arrays arranged in parallel relative one another along the reference direction, the first and second groove arrays are disposed adjacent one another, the third and fourth groove arrays are disposed adjacent one another, the ejection grooves and the non-ejection grooves comprise first to fourth ejection grooves and first to fourth non-ejection grooves of the respective first to fourth groove arrays, the first opening portion is disposed between the second groove array and the third groove array, an end portion of the first ejection groove of the first groove array disposed on a side of the second groove array and an end portion of the second non-ejection groove of the second groove array disposed on a side of the first groove array are spaced apart from each other and overlap with each other in a thickness direction of the piezoelectric body substrate, and an end portion of the third ejection groove of the third groove array disposed on a side of the fourth groove array and an end portion of the fourth non-ejection groove of the fourth groove array disposed on a side of the third groove array are spaced apart from each other and overlap with each other in a thickness direction of the piezoelectric body substrate.

7. The liquid jet head according to claim 5, wherein each of the ejection grooves of each of the plurality of groove arrays has a convex shape in a direction from the upper surface to the lower surface of the piezoelectric body substrate; and wherein each of the non-ejection grooves of each of the plurality of groove arrays has a convex shape in a direction from the lower surface to the upper surface of the piezoelectric body substrate.

8. The liquid jet head according to claim 1, further comprising:

a nozzle plate having a plurality of nozzle arrays, in each of which nozzles configured to communicate with the ejection grooves are arrayed in the reference direction, the nozzle plate being bonded to the lower surface of the piezoelectric body substrate.

9. A liquid jet apparatus comprising:

the liquid jet head according to claim 1;

a movement mechanism configured to relatively move the liquid jet head and a recording medium;

a liquid supply tube configured to supply liquid to the liquid jet head; and a liquid tank configured to supply the liquid to the liquid supply tube.

10. The liquid jet head according to claim 1, wherein the two groove arrays between which the first opening portion penetrates from the upper surface to the lower surface of the piezoelectric body substrate are disposed in a middle position of the plurality of groove arrays.

11. A liquid jet head comprising:

a piezoelectric body substrate having an upper surface, a lower surface, at least two groove arrays each having ejection grooves penetrating from the upper surface to the lower surface, and a first opening portion penetrating from the upper surface to the lower surface between the at least two groove arrays;

drive electrodes provided on side surfaces of the ejection grooves;

terminal electrodes electrically connected to the drive electrodes; and a flexible circuit board electrically connected to the terminal electrodes, the flexible circuit board extending from the lower surface to the upper surface of the piezoelectric body substrate through the first opening portion.

12. A liquid jet head according to claim 11, wherein the at least two groove arrays comprises four groove arrays arranged parallel to one another, the first opening portion of the piezoelectric body substrate being formed between two adjacent groove arrays from among the four groove arrays.

13. A liquid jet head according to claim 11, further comprising a cover plate bonded to the upper surface of the piezoelectric body substrate and having a liquid chamber configured to communicate with the ejection grooves of the at least two groove arrays, the cover plate having a second opening portion through which the flexible circuit board extends.

14. The liquid jet head according to claim 13, further comprising a flow path plate bonded to the cover plate and having flow paths communicating with the liquid chamber of the cover plate.

15. The liquid jet head according to claim 11, wherein each of the at least two groove arrays has non-ejection grooves alternately arrayed with the ejection grooves and penetrating from the upper surface to the lower surface of the piezoelectric body substrate; and wherein the piezoelectric body substrate has drive electrodes provided on side surfaces of the non-ejection grooves.

16. The liquid jet head according to claim 15, wherein the at least two groove arrays comprises first to fourth groove arrays arranged in parallel relative one another along the reference direction, the first and second groove arrays being disposed adjacent one another, and the third and fourth groove arrays being disposed adjacent one another; wherein the ejection grooves and the non-ejection grooves comprise first to fourth ejection grooves and first to fourth non-ejection grooves of the respective first to fourth groove arrays; wherein an end portion of the first ejection groove of the first groove array disposed on a side of the second groove array and an end portion of the second non-ejection groove of the second groove array disposed on a side of the first groove array are spaced apart from each other and overlap with each other in a thickness direction of the piezoelectric body substrate; and wherein an end portion of the third ejection groove of the third groove array disposed on a side of the fourth groove array and an end portion of the fourth non-ejection groove of the fourth groove array disposed on a side of the third groove array are spaced apart from each other and overlap with each other in a thickness direction of the piezoelectric body substrate.

17. The liquid jet head according to claim 15, wherein each of the ejection grooves of each of the at last two of groove arrays has a convex shape in a direction from the upper surface to the lower surface of the piezoelectric body substrate; and wherein each of the non-ejection grooves of each of the at least two groove arrays has a convex shape in a direction from the lower surface to the upper surface of the piezoelectric body substrate.

18. The liquid jet head according to claim 11, further comprising a nozzle plate bonded to the lower surface of the piezoelectric body substrate, the nozzle plate having a plurality of nozzle arrays in each of which nozzles configured to communicate with the ejection grooves are arrayed.

19. A liquid jet apparatus comprising:

the liquid jet head according to claim 11;

a movement mechanism configured to relatively move the liquid jet head and a recording medium;

a liquid supply tube configured to supply liquid to the liquid jet head; and a liquid tank configured to supply the liquid to the liquid supply tube.

* * * * *